US007703621B2

(12) United States Patent
Evans et al.

(10) Patent No.: US 7,703,621 B2
(45) Date of Patent: Apr. 27, 2010

(54) MOISTURE RETENTION SEAL

(75) Inventors: Christopher T. Evans, Long Valley, NJ (US); Christopher Gieda, Long Valley, NJ (US); Kristin S. Speck, Livermore, CA (US); Jose M. Arevalo, Hercules, CA (US)

(73) Assignee: Union Street Brand Packaging LLC, Northborough, MA (US)

( * ) Notice: Subject to any disclaimer, the term of this patent is extended or adjusted under 35 U.S.C. 154(b) by 471 days.

(21) Appl. No.: 11/212,111

(22) Filed: Aug. 25, 2005

(65) Prior Publication Data

US 2007/0045315 A1 Mar. 1, 2007

(51) Int. Cl.
*B65D 51/18* (2006.01)
*B65D 51/04* (2006.01)

(52) U.S. Cl. ..... 220/254.3; 220/836

(58) Field of Classification Search ..... 220/254.3, 220/254.1, 801, 796, 789, 794, 810, 836, 220/361, 363, 839, 666, 659, 657, 656; 215/45, 215/43, 316, 324, 325, 333, 902, 327, 344, 215/343, 341, 317, 40, 200
See application file for complete search history.

(56) References Cited

U.S. PATENT DOCUMENTS

| | | | | | |
|---|---|---|---|---|---|
| 1,470,686 | A | * | 10/1923 | Carpenter | 220/254.3 |
| 2,099,056 | A | * | 11/1937 | Ferngren | 229/5.5 |
| 2,754,866 | A | | 7/1956 | Coltman et al. | 150/0.5 |
| 3,127,052 | A | * | 3/1964 | Mayers | 220/495.11 |
| 3,339,770 | A | * | 9/1967 | Weigand | 215/214 |
| 3,592,349 | A | * | 7/1971 | Baugh | 215/307 |
| 3,732,909 | A | | 5/1973 | Rooke et al. | 150/0.5 |
| 3,967,756 | A | | 7/1976 | Barish | 221/45 |
| 3,982,659 | A | | 9/1976 | Ross | 221/63 |
| 4,180,178 | A | | 12/1979 | Turner | 220/281 |
| 4,251,002 | A | | 2/1981 | Middleton et al. | 215/253 |

(Continued)

FOREIGN PATENT DOCUMENTS

| | | |
|---|---|---|
| DE | 43 09 383 | 9/1994 |

(Continued)

OTHER PUBLICATIONS

Authorized Officer Olivier Piolat, *International Search Report and Written Opinion of the International Searching Authority*, International Application No. PCT/US2006/033277, Jan. 4, 2007, 11 pages

*Primary Examiner*—Anthony Stashick
*Assistant Examiner*—Robert J Hicks
(74) *Attorney, Agent, or Firm*—Sunstein Kann Murphy & Timbers LLP

(57) ABSTRACT

Provided is a moisture retention seal for use with a package. The moisture retention seal includes an opened-ended canister having a plurality of canister sealing surfaces. Snap-fitted with spatial interference to the canister at its opened-end, is a moisture retention closure having a plurality of closure sealing surfaces. Each canister sealing surface cooperates with a corresponding one of the closure sealing surfaces to form a plurality of partial seals. At least one of the partial seals includes a micro-bead surface comprising one or more small, inwardly directed, narrowly spaced-apart, micro-bead elements. The package that includes a moisture retention seal of the present invention employs only molded parts and does not require gaskets or secondary seals.

27 Claims, 6 Drawing Sheets

U.S. PATENT DOCUMENTS

| | | | | | |
|---|---|---|---|---|---|
| 4,335,827 | A | | 6/1982 | Knize et al. | 220/284 |
| 4,496,066 | A | | 1/1985 | Bullock, III | 215/320 |
| 4,601,938 | A | | 7/1986 | Deacon et al. | 428/153 |
| 4,699,285 | A | * | 10/1987 | Perne et al. | 215/252 |
| 4,711,372 | A | * | 12/1987 | Gach | 222/23 |
| 4,878,595 | A | | 11/1989 | Uhlig | 220/306 |
| 4,967,926 | A | | 11/1990 | Morris, Sr. | 220/323 |
| D315,671 | S | | 3/1991 | Zaragoza | D9/523 |
| 5,036,991 | A | | 8/1991 | Wallman | 215/256 |
| 5,213,225 | A | | 5/1993 | King et al. | 215/330 |
| 5,238,130 | A | | 8/1993 | Marques et al. | 215/216 |
| 5,284,261 | A | * | 2/1994 | Zambuto | 215/11.5 |
| 5,379,910 | A | | 1/1995 | Montgomery | 215/346 |
| 5,542,567 | A | | 8/1996 | Julius | 221/63 |
| 5,579,933 | A | | 12/1996 | Hofmann | 215/220 |
| 5,718,353 | A | | 2/1998 | Kanfer et al. | 221/63 |
| 6,044,994 | A | | 4/2000 | Miller | 215/344 |
| 6,145,782 | A | | 11/2000 | King et al. | 242/593 |
| 6,152,322 | A | | 11/2000 | Marino | 221/63 |
| 6,158,614 | A | | 12/2000 | Haines et al. | 221/63 |
| 6,202,870 | B1 | | 3/2001 | Pearce | 215/307 |
| 6,214,784 | B1 | | 4/2001 | Robbins et al. | 510/423 |
| 6,306,810 | B1 | | 10/2001 | Cheung et al. | 510/238 |
| 6,328,252 | B1 | | 12/2001 | Neveu et al. | 242/593 |
| 6,382,444 | B1 | | 5/2002 | Nyman | 215/252 |
| 6,398,067 | B1 | * | 6/2002 | Belfance et al. | 220/833 |
| 6,412,656 | B1 | | 7/2002 | Placik | 221/33 |
| 6,440,916 | B1 | | 8/2002 | Cheung et al. | 510/238 |
| 6,491,185 | B1 | | 12/2002 | Azzarello et al. | 220/783 |
| 6,514,923 | B1 | | 2/2003 | Cheung et al. | 510/238 |
| D471,440 | S | | 3/2003 | Sams et al. | D9/339 |
| 6,554,156 | B1 | | 4/2003 | Chong | 221/63 |
| 6,588,618 | B1 | | 7/2003 | Davis | 220/254.7 |
| 6,786,447 | B2 | | 9/2004 | Geib et al. | 242/588.3 |
| 6,910,579 | B2 | | 6/2005 | Reinke et al. | 206/494 |
| 6,951,292 | B2 | | 10/2005 | Bando et al. | 220/254.5 |
| 7,000,792 | B2 | * | 2/2006 | Arai | 215/237 |
| 7,198,161 | B2 | * | 4/2007 | Bucholtz | 215/237 |
| 7,537,132 | B2 | | 5/2009 | Marple et al. | 220/254.7 |
| 2002/0179627 | A1 | | 12/2002 | Huang et al. | 221/63 |
| 2003/0221986 | A1 | | 12/2003 | Reinke et al. | 206/494 |
| 2004/0112906 | A1 | | 6/2004 | Von Holdt, Jr. | 220/657 |
| 2005/0087543 | A1 | | 4/2005 | Smith | 221/63 |
| 2005/0205594 | A1 | | 9/2005 | Evans et al. | 221/63 |
| 2005/0242095 | A1 | | 11/2005 | Serrano et al. | 220/254.3 |
| 2006/0016776 | A1 | | 1/2006 | Barre et al. | 215/237 |
| 2006/0016821 | A1 | | 1/2006 | Liu | 220/780 |
| 2006/0191933 | A1 | | 8/2006 | Hicks et al. | 220/254.3 |

FOREIGN PATENT DOCUMENTS

| | | | | |
|---|---|---|---|---|
| DE | 299 14 522 | | | 10/1999 |
| EP | 0179498 (A1) | | | 4/1986 |
| EP | 0179498 (B1) | | | 7/1989 |
| EP | 1 366 699 | A2 | | 12/2003 |
| GB | 2 111 470 | | | 7/1983 |
| GB | 2244040 | A | * | 11/1991 |

* cited by examiner

MOISTURE RETENTION SEAL

FIELD OF THE INVENTION

The present invention relates to fluid seals. More particularly, the present invention relates to a moisture retention seal for plastic packages.

BACKGROUND OF THE INVENTION

FIG. 1A is an exploded side view of a prior art package 100 that included a cylindrically-shaped prior art canister 102 and a cup-shaped prior art closure 104, which was assembled telescopically over the opened-end of prior art canister 102. Prior art closure 104 has an inside diameter that is somewhat smaller than the outside diameter of prior art canister 102. Prior art canister 102 and prior art closure 104, when assembled as shown in dotted line, combined and cooperated to form a prior art seal 106 (FIG. 1B). Prior art canister 102 included a bottom 108, generally configured as a disk, and a sidewall 110, generally configured as a cylindrical surface, coupled to and extending upwardly from the peripheral edge of bottom 108. Prior art canister 102 included an opened-end portion 112 defining an opening 129 for access from the top of prior art canister 102 to material or objects contained therein. Typically, prior art canister 102 was formed integrally, by, for example, blow-molding or injection-molding of thermoplastic material.

Prior art closure 104 included a top 114, generally configured as a disk, and a skirt 116, generally configured as an annular ring, coupled to and depending downwardly from the peripheral edge of top 114. Top 114 defined an aperture 118 (FIG. 1B) therethrough for extracting material or objects contained in prior art canister 102 from its opened-end portion 112 after assembly of prior art canister 102 and prior art closure 104. Often, prior art package 100 further included an aperture lid 120 to close off aperture 118 of prior art closure 104. In one embodiment, aperture lid 120 was coupled to prior art closure 104 by a living hinge 122, by which aperture lid 120 pivoted with respect to prior art closure 104 to close off aperture 118 of prior art closure 104. Typically, prior art closure 104 was also formed integrally, by, for example, blow-molding or injection-molding of thermoplastic material. To form a seal between aperture lid 120 and closure 104, aperture lid 120 was typically snap-fitted to closure 104 in a manner well known to one of ordinary skill in the art. Aperture lid 120 included a lid sealing ring 132 near the outer peripheral edge on the bottom surface of aperture lid 120. Lid sealing ring 132 mated with a closure sealing ring 134 formed on the top surface of closure 104 when aperture lid 120 was pivoted, snap-fitted, and placed in a closed relationship with closure 104 to form a seal.

In use of prior art package 100, material or objects for containment and packaging in prior art package 100 were first placed in prior art canister 102 through opening 129 (FIG. 1B) with prior art closure 104 removed as shown in FIG. 1A. After, the material was loaded in prior art canister 102, prior art closure 104 was telescoped or fitted over and coupled to prior art canister 102 by snap-fitting, thread-fitting, or other means well known to those of ordinary skill in the art. Moist or liquid materials where often packaged in prior art package 100. For example, moistened wipes were packaged within prior art package 100 for dispensing through aperture 118.

FIG. 1B is a partial cross-sectional side view of opened-end portion 112 of prior art canister 102 of FIG. 1A after assembly with prior art canister 102 showing prior art seal 106. FIG. 1C is a close-up view of the portion of FIG. 1B shown in dotted line and identified by reference number 1C' showing prior art seal 106 in detail. Referring to FIGS. 1B and 1C together, the exterior surface of opened-end portion 112 of prior art canister 102 defined a sidewall groove 124, configured generally as an annular shaped indentation circumferentially about prior art canister 102. Sidewall groove 124 extended radially inwardly from and circumferentially about the exterior surface of prior art canister 102 proximate opened-end portion 112. As shown, the upper edge surface of sidewall groove 124 forms a sidewall undercut surface 126 that is beveled downwardly from its exterior to its interior indent.

The interior surface of skirt 116 of prior art closure 104 defined a skirt bead surface 128, configured generally as a peripheral flange protrusion, sometimes referred to as a bead, adjacent the bottom of skirt 116. Skirt bead surface 128 extended radially inwardly from and circumferentially about the interior surface of skirt 116 of prior art closure 104. Prior art canister 102 was assembled with prior art closure 104 by snapping skirt bead surface 128 into sidewall groove 124 whereby prior art closure 104 was retained on prior art canister 102 by means of abutting contact of skirt bead surface 128 with sidewall undercut surface 126 of sidewall groove 124.

In prior art package 100, prior art canister 102 and prior art closure 104 were further configured such that, after assembly, sidewall undercut surface 126 of sidewall groove 124 of prior art canister 102 abuttingly contacted and cooperated with corresponding skirt bead surface 128 of prior art closure 104 to form prior art seal 106. Prior art seal 106 was somewhat effective at avoiding moisture evaporation and in retaining liquid or moisture contained in prior art package 100. Prior art seal 106 slowed the loss of the liquid in the form of gaseous water vapor or other volatilized gas at the prior art seal 106 sealing interface between prior art canister 102 and prior art closure 104.

However, in the packaging industry, plastic canisters and closures often may not be accurately sized or may be out-of-round so that cooperating surfaces of the closure and canister do not properly and accurately seal. In addition, the canister and closure may be manufactured by different entities and the dimensional tolerances may vary greatly. In addition, for threaded prior art packages, to facilitate threading of the closure relative to the canister, ample thread tolerances are used, which results in axial and radial displacement sufficient to cause misalignment of the cooperating sealing surfaces. All of these variables and dimensional tolerances make it difficult to ensure a good seal in prior art packages. Poor quality seals resulted in the loss of an inordinate amount of moistening solution added to canister/closure plastic packages thereby requiring high initial moisture loading to avoid product dry-out during storage. High initial moisture loading added to over-all product cost.

In the prior art, expensive elastomeric gaskets or "O" rings were often used to provide better seals that slowed moisture loss from the package. In addition, well-known but expensive secondary seals, such as induction seals or heat seals, were often used in prior art packaging to retain moisture during distribution and in-store or user storage before product use.

SUMMARY OF THE INVENTION

In accordance with the principles of the present invention, provided is a moisture retention seal that avoids the limitations and expense of prior art seals. The moisture retention seal includes a first moisture retention component having a plurality of first component sealing surfaces. Assembled with the first moisture retention component is a second moisture retention component having a plurality of second component sealing surfaces. Each first component sealing surface cooperates with a corresponding one of the second component sealing surfaces to form a plurality of partial seals. At least one of the partial seals comprises one or more small projections, sometimes referred to as micro-bead elements. In one embodiment, first moisture retention component, second moisture retention component, or both are formed from molded thermoplastic material.

When it is said herein that a first surface cooperates with second surface to form a seal, it is meant that the first and second surfaces abuttingly contact each other and deform sufficiently due to spatial interference to form a fluid seal useful in preventing moisture transfer across the seal. When it is said herein that a first sealing surface corresponds to a second sealing surface, it is meant that the first sealing surface and second sealing surface are intended to cooperate to form a moisture retention seal.

Embodiments of a moisture retention seal for use with a package include an opened-ended canister having a plurality of canister sealing surfaces. Snap-fitted to the canister at its opened-end is a moisture retention closure having a plurality of closure sealing surfaces. Each canister sealing surface cooperates with a corresponding one of the closure sealing surfaces to form a plurality of partial seals. The closure may be configured to be slightly smaller in diameter than the canister, thereby forming an interference fit between the closure and the canister. The interference may provide a sealing engagement between the closure and the canister at the points of interference along the plurality of cooperating partial seals. At least one of the partial seals includes a micro-bead surface comprising one or more small, inwardly directed, narrowly spaced-apart, micro-bead elements. In one embodiment, a package that includes a moisture retention seal employs only molded parts and does not require expensive gaskets or secondary seals. Accordingly, the moisture retention seal of the present invention avoids the limitations and expense of prior art seals.

BRIEF DESCRIPTION OF THE DRAWINGS

The foregoing aspects and others will be readily appreciated by the skilled artisan from the following description of illustrative embodiments when read in conjunction with the accompanying drawings, wherein.

Reference will now be made to the drawings wherein like numerals refer to like parts throughout. As used herein, positional terms, such as "bottom" and "top" and the like, and directional terms, such as "up", "down" and the like, are employed for ease of description in conjunction with the drawings. Further, the terms "interior", "inwardly" and the like, refer to positions and directions toward the geometric center of embodiments of the present invention and designated parts thereof. The terms "exterior", "outwardly", and the like, refer to positions and directions away from the geometric center. None of these terms is meant to indicate that the described components must have a specific orientation except when specifically set forth.

DESCRIPTION OF ILLUSTRATIVE EMBODIMENTS

Figure 2A:
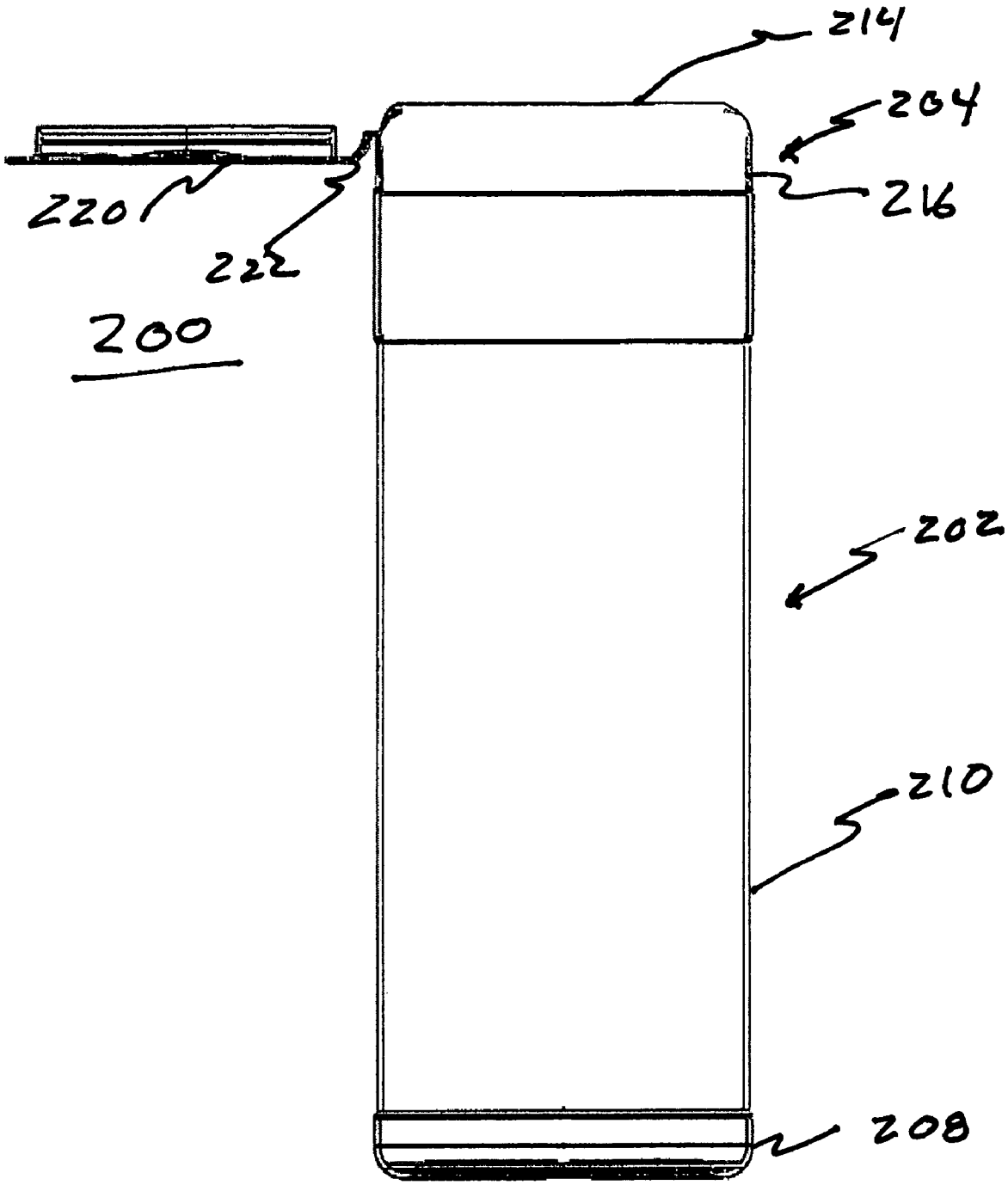
FIG. 2A is a side view of an assembled moisture retention package that includes a cylindrical moisture retention canister and a cup-shaped moisture retention closure coupled to and cooperating with the moisture retention canister to provide an embodiment of a moisture retention seal in accordance with the principles of the present invention.

FIG. 2A is a side view of an assembled moisture retention package 200 that includes a cylindrical moisture retention canister 202 and a cup-shaped moisture retention closure 204 coupled to and cooperating with moisture retention canister 202 to provide an embodiment of a moisture retention seal 206 (FIG. 2B) in accordance with the principles of the present invention. In one embodiment, moisture retention canister 202 includes a bottom 208, generally configured as a disk, and a sidewall 210, generally configured as a cylindrical surface, coupled to and extending upwardly from the peripheral edge of bottom 208. Moisture retention canister 202 includes an opened-end portion 212 (FIG. 2B) defining an opening 229 (FIG. 2B) for access from the top of moisture retention canister 202 to material or objects contained therein. In one embodiment moisture retention canister 202 is integrally formed and comprises blow-molded or injection-molded thermoplastic material.

Figure 2B:
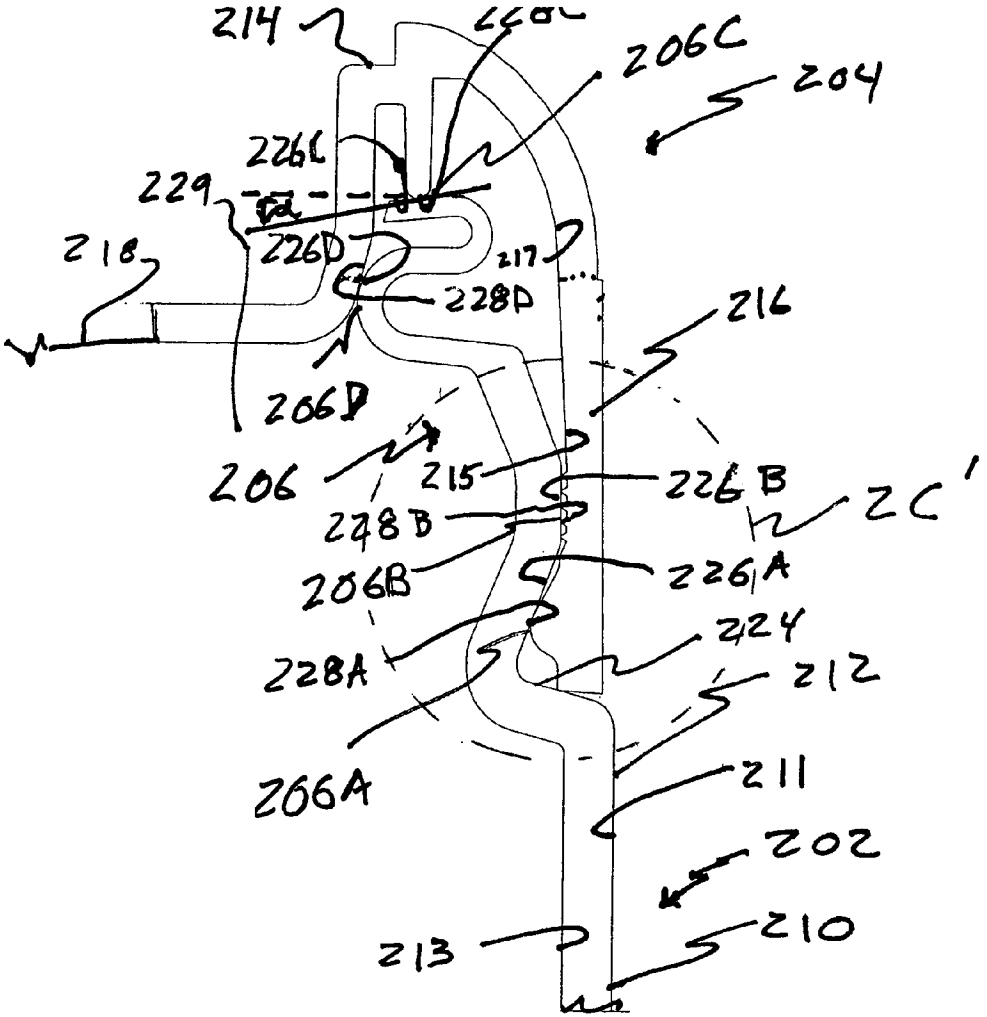
FIG. 2B is a cross-sectional close-up side view of an opened-end portion of the moisture retention canister that shows a plurality of partial seals after assembly of the moisture retention closure and moisture retention canister.

In one embodiment, moisture retention closure 204 includes a top 214, generally configured as a disk, and a skirt 216, generally configured as an annular ring or skirt, coupled to and depending downwardly from top 214 at the peripheral edge of top 214. Top 214 defines an aperture 218 (FIG. 2B) therethrough for extracting material or objects contained in moisture retention canister 202 from opened-end portion 212 (FIG. 2B). In one embodiment, moisture retention closure 204 is integrally formed by blow-molding or injection-molding and comprises thermoplastic material.

In one embodiment, moisture retention package 200 further includes an aperture lid 220 to close off aperture 218. Aperture lid 220 may be coupled to moisture retention closure 204 by a living hinge 222, by which aperture lid 220 pivots with respect to moisture retention closure 204 to close off aperture 218 (FIG. 2B) of moisture retention closure 204.

FIG. 2B is a cross-sectional close-up side view of opened-end portion 212 of moisture retention canister 202 that shows various seals 206A-206D after assembly of moisture retention closure 204 and moisture retention canister 202. In illustrative embodiments, the plurality of seals are partial seals that together can form a complete seal that adequately seals for anticipated uses. For example, each partial seal may have a small unsealed area. The combination of these small unsealed areas, however, may present a relatively tortuous path for vapor to escape, thus providing an effective seal for certain applications. In other embodiments, however, at least one of the seals is a full seal. In such case, the other full or partial seals simply are redundant. In either case, it is anticipated that redundant seals can help ensure that at least one is a full seal, or at least the combination of partial seals provides the requisite sealing capabilities. Such use of redundant seals should increase the likelihood that wide error factors and tolerances of some technologies (e.g., blow molding technology) does not eliminate sealing requirements. Unless the context requires otherwise or the seal is explicitly specified as a partial or full seal, seals discussed herein thus may be either partial or full seals.

Referring to FIG. 2B and directing attention to moisture retention canister 202, sidewall 210 comprises a plurality of sealing surfaces 226A-226D. As shown in FIG. 2B, sidewall 210 has a first, i.e., an exterior, sidewall surface 211 and a second, i.e., an interior, sidewall surface 213 opposite exterior sidewall surface 211. Exterior sidewall surface 211 of moisture retention canister 202 defines sidewall sealing surfaces that include a sidewall undercut surface 226A, a sidewall upright surface 226B, and a sidewall lip surface 226C. In one embodiment, sidewall undercut surface 226A, sidewall upright surface 226B, and sidewall lip surface 226C, circumferentially extend about exterior sidewall surface 211 of moisture retention canister 202.

With reference to sidewall undercut surface 226A, exterior sidewall surface 211 has sidewall groove 224, configured generally as an annular shaped indentation about moisture retention canister 202 proximate opened-end portion 212. Sidewall groove 224 extends radially inward from and circumferentially about exterior sidewall surface 211 of moisture retention canister 202. As shown, the upper edge surface of sidewall groove 224 forms sidewall undercut surface 226A. In one embodiment, sidewall undercut surface 226A slants downwardly from exterior sidewall surface 211 to its interior indent.

With reference to sidewall upright surface 226B, in one embodiment, sidewall upright surface 226B is above sidewall undercut surface 226A and is configured generally as an annular ring with a substantially flat-face directed outwardly.

With reference to sidewall lip surface 226C, in one embodiment, sidewall lip surface 226C is the top generally horizontal annular surface of exterior sidewall surface 211 forming a flat-faced upper lip or rim of moisture retention canister 202. As described more fully below, sidewall lip surface 226C deflects and pivots downwardly by a deflection angle $\alpha$ from its unassembled relaxed horizontal position whenever moisture retention closure 204 is fully assembled and engaged with moisture retention canister 202.

In one embodiment, interior sidewall surface 213 of moisture retention canister 202 defines a sidewall bead surface 226D circumferentially extending about interior sidewall surface 213. Sidewall bead surface 226D is configured generally as a peripheral flange protrusion, sometimes, as described above, referred to as a bead, adjacent and below sidewall lip surface 226C. Sidewall bead surface 226D extends radially inwardly from and circumferentially about interior sidewall surface 213 of moisture retention canister 202.

Referring still to FIG. 2B but directing attention to moisture retention closure 204, skirt 216 and top 214 of moisture retention closure 204 comprise a plurality of sealing surfaces 228A-228D. In one embodiment, skirt 216 of moisture retention closure 204 has a first, i.e., an interior, skirt surface 215. Skirt interior surface 215 of moisture retention closure 204 defines sidewall sealing surfaces that include a skirt bead surface 228A and a skirt micro-bead surface 228B.

With reference to skirt bead surface 228A, in one embodiment, skirt bead surface 228A is configured as a bead, as described above, adjacent the bottom of skirt 216. Skirt bead surface 228A extends radially inwardly from and circumferentially about skirt interior surface 215 of moisture retention closure 204. When moisture retention package 200 is assembled as described, skirt bead surface 228A of closure 204 cooperates with sidewall undercut surface 226A of canister 202 to form a first partial seal 206A.

Figure 2C:
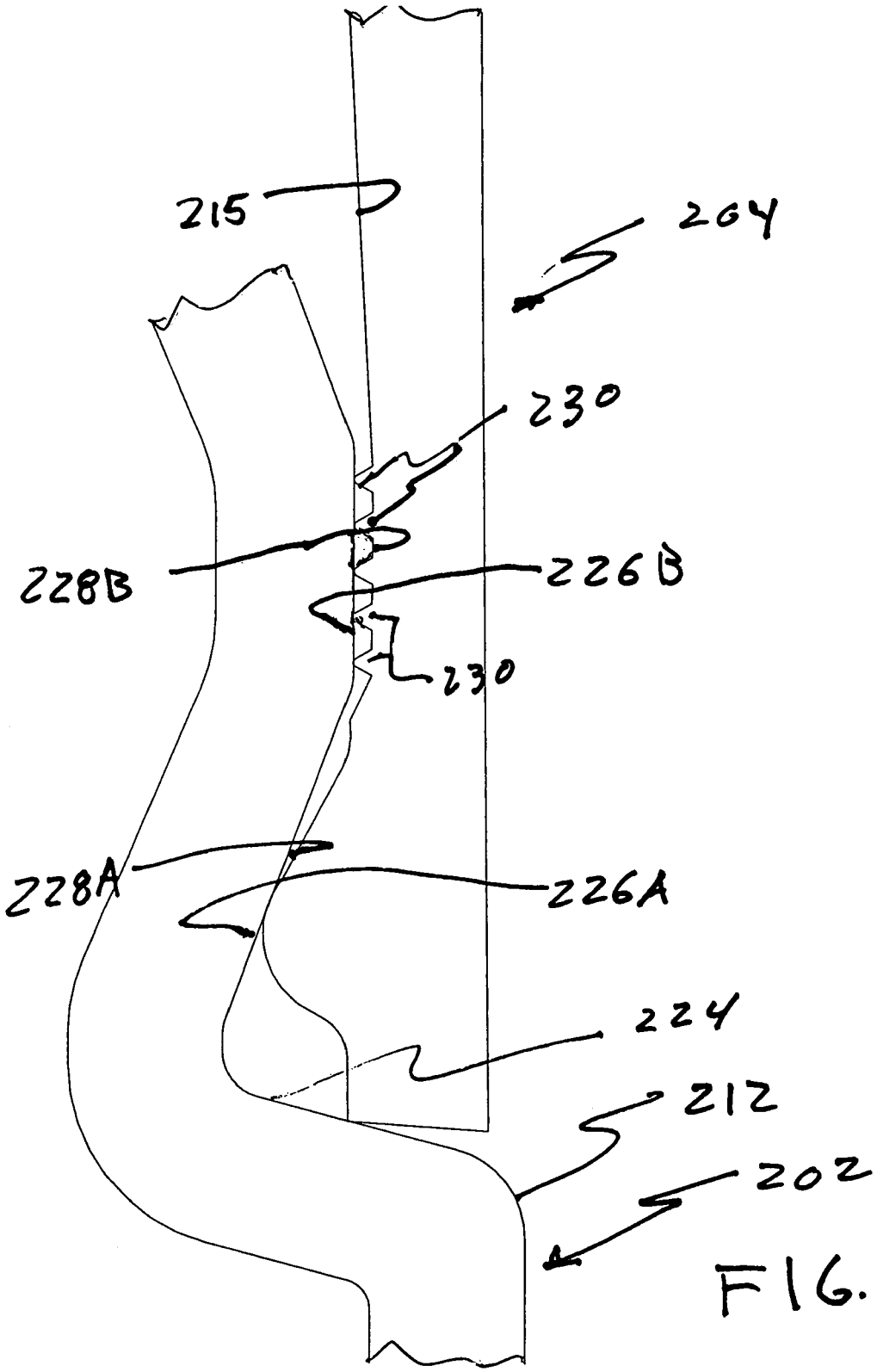
FIG. 2C is a further close-up view of the portion of FIG. 2B shown in dotted line and identified by reference number 2C' showing a skirt micro-bead surface in detail.

With reference to skirt micro-bead surface 228B FIG. 2C is a further close-up view of the portion of FIG. 2B shown in dotted line and identified by reference number 2C' showing skirt micro-bead surface 228B in detail. Referring now to FIGS. 2B and 2C together, in one embodiment, skirt micro-bead surface 228B is configured as one or more, small, narrowly spaced-apart beads, sometimes referred to as micro-bead elements 230, best seen in FIG. 2C. In illustrative embodiments, the micro-bead elements 230 each have bases that are spaced approximately one to four base thicknesses apart.

In one embodiment, each micro-bead element 230 of micro-bead surface 228B protrudes from skirt interior surface 215 toward the interior of moisture retention closure 204 by about 0.013 inches. Adjacent micro-bead elements 230 are spaced-apart by about 0.030 inches. The micro-bead elements 230 making up micro-bead surface 228B cooperate with sidewall upright surface 226B to form a second partial seal 206B. Micro-bead surface 228B is particularly effective in retaining moisture within moisture retention package 200 when moisture retention canister 202 and moisture retention closure 204 are assembled. Each of the micro-bead elements 230 abuttingly contacts sidewall upright surface 226B, which together form a tight seal.

In one embodiment, moisture retention closure 204 has an inside diameter at skirt bead surface 228A that is somewhat smaller than moisture retention canister 202 outside diameter at corresponding sidewall undercut surface 226A. Further, moisture retention closure 204 has an inside diameter at skirt micro-bead surface 228B that is somewhat smaller than moisture retention canister 202 outside diameter at corresponding sidewall upright surface 226B. Accordingly, as is well known to those of ordinary skill in the art, moisture retention closure 204 snap-fits to moisture retention canister 202 when assembled as shown in FIG. 2A. When it is said herein that the diameter of a surface of a component is somewhat smaller than the diameter of a surface of another component, it is meant that the diameters differ in length by an amount that allows cooperation between the components to form spatial interference therebetween. In one embodiment the inside diameter at skirt bead surface 228A is smaller than the outside diameter of sidewall undercut surface 226A by about 0.014 inches. The inside diameter of skirt micro-bead surface 228B is smaller than the outside diameter of sidewall upright surface 226B by about 0.029 inches. The inside diameters must not be so much smaller than the outside diameters such that moisture retention closure 204 will not conveniently snap-fit on moisture retention canister 202.

Referring again to FIG. 2B, further, top 214 of moisture retention closure 204 has a first, i.e., an interior, top surface 217. Top interior surface 217 of moisture retention closure 204 defines sealing surfaces that include a top protrusion surface 228C and a top undercut surface 228D. In one embodiment, top protrusion surface 228C and top undercut surface 228D circumferentially extend about interior top surface 217 of moisture retention closure 204.

With reference to top protrusion surface 228C, in one embodiment, top protrusion surface 228C is configured as a tang or projection coupled to and protruding downwardly from top interior surface 217. When moisture retention package 200 is assembled as described, top protrusion surface 228C of closure 204 cooperates with sidewall lip surface 226C of canister 202 to form a third partial seal 206C. As noted above, sidewall lip surface 226C deflects somewhat downwardly from its unassembled relaxed position, by deflection angle α, whenever moisture retention closure 204 is fully assembled and engaged with moisture retention canister 202. The downward deflection of sidewall lip surface 226C generates, at top protrusion surface 228C, an upwardly biasing force on closure 204, as sidewall lip surface 226C tends to elastically return to its relaxed position. The upwardly biasing force on closure 204 at top protrusion surface 228C causes sidewall lip surface 226C to more forcefully engage sidewall lip surface 226C in abutting contact, thereby forming a more effective third partial seal 206C. Further, the upwardly biasing force on closure 204 causes skirt bead surface 228A to more forcefully engage undercut surface 226A in abutting contact, thereby forming a more effective first partial seal 206A. In one embodiment, deflection angle α is about 5°.

With reference to top undercut surface 228D, in one embodiment, top undercut surface 228D is configured as a bead extending circumferentially about top interior surface 217. When moisture retention canister 202 and moisture retention closure 204 are assembled, top undercut surface 228D cooperates with sidewall bead surface 226D to form a fourth partial seal 206D.

As noted above, in one embodiment, moisture retention closure 204 has an inside diameter at skirt bead surface 228A that is somewhat smaller than moisture retention canister 202 outside diameter at corresponding sidewall undercut surface 226A. Further, moisture retention closure 204 has an inside diameter at skirt micro-bead surface 228B that is somewhat smaller than moisture retention canister 202 outside diameter at corresponding sidewall upright surface 226B. Thus, when assembled as shown in FIG. 2A, moisture retention closure 204 and moisture retention canister 202 spatially interfere at first partial seal 206A and second partial seal 206B. Moisture retention closure 204 may thus "snap-fit" when assembled to moisture retention canister 202.

To accommodate the spatial interferences at first partial seal 206A and second partial seal 206B, opened-end portion 212 of moisture retention canister 202 tends to lengthen. The lengthening of opened-end portion 212 in turn creates a more effective third partial seal 206C, since sidewall lip surface 226C of canister 202 is, in turn, more forcefully biased against and more effectively seated with top protrusion surface 228C of closure 204. To accommodate this more forceful biasing at third partial seal 206C, deflection angle α of canister 202 tends to increase and sidewall bead surface 226D tends to deflect inwardly toward top undercut surface 228D of moisture retention closure 204 thereby, in turn, creating a more effective fourth partial seal 206D.

Thus, it can be seen that the interference created by selecting moisture retention closure 204 with inside diameters at skirt bead surface 228A and skirt micro-bead surface 228B that are somewhat smaller, respectively, than the outside diameters of sidewall undercut surface 226A and sidewall upright surface 226B of moisture retention canister 202, produces more effective seals at all the partial seals 206A-206D of moisture retention package 200. A more effective overall "system" of cooperating partial seals is created by selection of the diameters of moisture retention canister 202 and moisture retention closure 204. The various elements of the seal "system" flex and deflect as described to accommodate induced forces thereby creating a more effective overall sealing system.

To determine the effectiveness of moisture retention seal 206, comprising partial seals 206A-206D, moisture retention package 200 was tested and compared to prior art seal 106 (FIG. 1C) of prior art package 100 (FIG. 1A) for weight percent moisture loss over time.

Figure 1A:
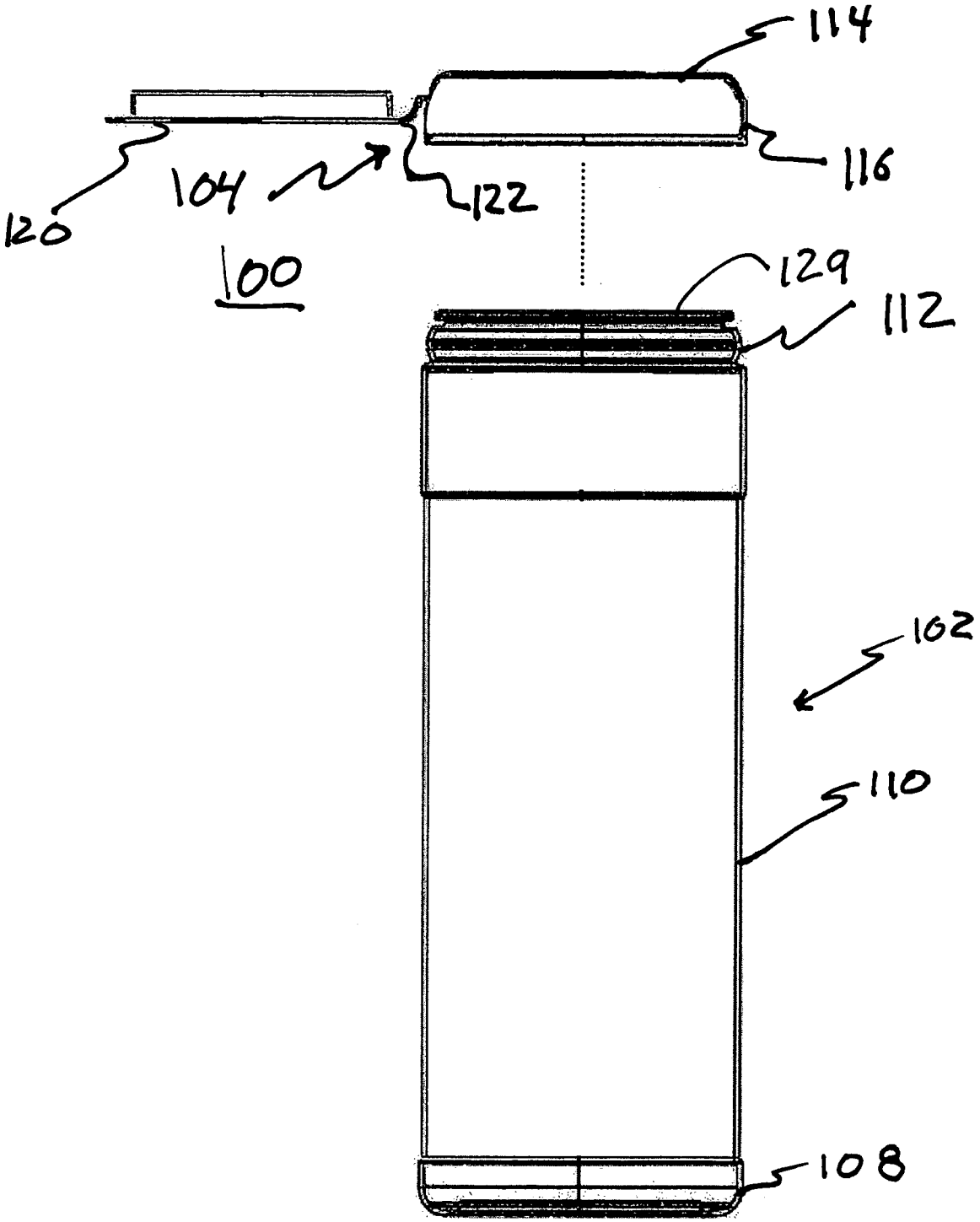
FIG. 1A (PRIOR ART)
FIG. 1A is an exploded side view of a prior art package that included a cylindrically-shaped prior art canister and a cup-shaped prior art closure.

Table 1 summarizes the weight percent moisture loss over time for moistened automotive interior protectant wipes stored in moisture retention package 200 as compared to identical wipes stored in prior art package 100 (FIG. 1A). As shown, wipes were stored at a constant ambient temperature of 70° F. and at constant elevated temperatures to accelerate results. The solution moistening the protectant wipes comprised 23.0 weight percent solids 77.0 weight percent aqueous volatiles.

As shown in Table 1 cumulative weight percent (wt %) moisture loss for moistened protectant wipes stored in moisture retention package 200 at 120° F. amounted to 6.74 wt % loss over a twelve-week period. By comparison, protectant wipes stored in prior art package 100 (FIG. 1A) lost 37.87 wt %. Moisture loss for moisture retention package 200 amounted to only 17.8% of the moisture loss for prior art package 100 (FIG. 1A) under these conditions (120° F., 12 weeks).

Table 2 summarizes the weight percent moisture loss over time for moistened general purpose orange scented cleaning wipes stored in moisture retention package 200 as compared to identical wipes stored in prior art package 100 (FIG. 1A). The solution moistening the orange scented cleaning wipes comprised 1.2 weight percent solids and 98.8 weight percent aqueous volatiles.

As shown in Table 2 cumulative weight percent moisture loss for moistened orange scented cleaning wipes stored in moisture retention package 200 at 120° F. amounted to 8.40 wt % loss over a twelve-week period. By comparison, orange scented cleaning wipes stored in prior art package 100 (FIG. 1A) lost 39.41 wt %. Moisture loss for moisture retention package 200 amounted to only 21.3% of the moisture loss for prior art package 100 (FIG. 1A) under these conditions (120° F., 12 weeks). When stored at a temperature of 140F, cumulative weight percent moisture loss amounted to 13.72 wt % and 69.70 wt % for moisture retention package 200 and prior art package 100 (FIG. 1A), respectively. Moisture loss for moisture retention package 200 amounted to only 19.7% of the moisture loss for prior art package 100 (FIG. 1A) under these conditions (140° F., 12 weeks).

Table 3 summarizes the weight percent moisture loss over time for moistened leather cleaning wipes stored in moisture retention package 200 as compared to identical wipes stored in prior art package 100 (FIG. 1A). The solution moistening the leather cleaning wipes comprised 10.7 weight percent solids and 89.3 weight percent aqueous volatiles.

As shown in Table 3 cumulative weight percent moisture loss for moistened leather cleaning wipes stored in moisture retention package 200 at 100 (FIG. 1A)° F. amounted to 4.56 wt % loss over a twelve-week period. By comparison, leather cleaning wipes stored in prior art package 100 (FIG. 1A) lost 20.21 wt %. Moisture loss for moisture retention package 200 amounted to only 22.7% of the moisture loss for prior art package 100 (FIG. 1A) under these conditions (100 (FIG. 1A)° F., 12 weeks). When stored at a temperature of 120F, cumulative weight percent moisture loss amounted to 11.08 wt % and 44.96 wt % for moisture retention package 200 and prior art package 100 (FIG. 1A), respectively. Moisture loss for moisture retention package 200 amounted to only 24.6% of the moisture loss for prior art package 100 (FIG. 1A) under these conditions (120° F., 12 weeks). When stored at a temperature of 140° F., cumulative weight percent moisture loss amounted to 11.87 wt % and 52.44 wt % for moisture retention package 200 and prior art package 100 (FIG. 1A), respectively. Moisture loss for moisture retention package 200 amounted to only 22.6% of the moisture loss for prior art package 100 (FIG. 1A) under these conditions (140° F., 12 weeks).

Moisture Weight Loss Summary

TABLE 1

| | Protectant Wipes | | | | |
|---|---|---|---|---|---|
| | Week 1 | Week 2 | Week 4 | Week 8 | Week 12 |
| Moisture Retention Seal Package 70° F. | | | | | |
| Weight % Lost | 0.015 | 0.17 | 0.28 | 0.52 | 0.78 |
| Standard Dev. | 0.02 | 0.02 | 0.03 | 0.04 | 0.05 |
| 100° F. | | | | | |
| Weight % Lost | 0.029 | 0.50 | 1.03 | 2.03 | 3.06 |
| Standard Dev. | 0.04 | 0.08 | 0.20 | 0.38 | 0.59 |
| 120° F. | | | | | |
| Weight % Lost | 0.69 | 1.16 | 2.31 | 4.50 | 6.74 |
| Standard Dev. | 0.017 | 0.18 | 0.29 | 0.61 | 1.04 |
| 140° F. | | | | | |
| Weight % Lost | 0.98 | 1.87 | 3.68 | 7.30 | 10.74 |
| Standard Dev. | 0.07 | 0.32 | 0.74 | 1.29 | 2.04 |
| Controls (Prior Art Package) 120° F. | | | | | |
| Weight % Lost | 3.50 | 6.20 | 12.59 | 25.11 | 37.87 |
| Standard Dev. | 0.81 | 1.37 | 2.72 | 5.41 | 8.30 |

TABLE 2

| | Orange Scented Cleaning Wipes | | | | |
|---|---|---|---|---|---|
| | Week 1 | Week 2 | Week 4 | Week 8 | Week 12 |
| Moisture Retention Seal Package 70° F. | | | | | |
| Weight % Lost | 0.16 | 0.19 | 0.36 | 0.75 | 1.18 |
| Standard Dev. | 0.07 | 0.07 | 0.08 | 0.09 | 0.11 |
| 100° F. | | | | | |
| Weight % Lost | 0.43 | 0.77 | 1.51 | 2.95 | 4.42 |
| Standard Dev. | 0.07 | 0.08 | 0.11 | 0.16 | 0.31 |
| 120° F. | | | | | |
| Weight % Lost | 0.85 | 1.53 | 2.34 | 5.43 | 8.40 |
| Standard Dev. | 0.06 | 1.16 | 1.19 | 0.53 | 0.82 |
| 140° F. | | | | | |
| Weight % Lost | 1.22 | 2.35 | 5.17 | 9.52 | 13.72 |
| Standard Dev. | 0.10 | 0.22 | 0.40 | 0.78 | 1.14 |
| Controls (Prior Art Package) 120° F. | | | | | |
| Weight % Lost | 3.83 | 7.16 | 13.43 | 25.88 | 39.41 |
| Standard Dev. | 2.85 | 4.41 | 6.68 | 11.44 | 16.11 |
| 140° F. | | | | | |

TABLE 2-continued

| | Orange Scented Cleaning Wipes | | | | |
|---|---|---|---|---|---|
| | Week 1 | Week 2 | Week 4 | Week 8 | Week 12 |
| Weight % Lost | 4.83 | 10.58 | 23.92 | 47.30 | 69.70 |
| Standard Dev. | 3.23 | 4.03 | −5.54 | 8.75 | 10.86 |

TABLE 3

| | Leather Cleaning Wipes | | | | |
|---|---|---|---|---|---|
| | Week 1 | Week 2 | Week 4 | Week 8 | Week 12 |
| Moisture Retention Seal Package 70° F. | | | | | |
| Weight % Lost | 0.19 | 0.22 | 0.43 | 0.88 | 1.35 |
| Standard Dev. | 0.03 | 0.03 | 0.05 | 0.11 | 0.19 |
| 100° F. | | | | | |
| Weight % Lost | 0.34 | 0.68 | 1.43 | 2.98 | 4.56 |
| Standard Dev. | 0.05 | 0.05 | 0.15 | 0.42 | 0.69 |
| 120° F. | | | | | |
| Weight % Lost | 1.13 | 1.86 | 3.82 | 7.59 | 11.08 |
| Standard Dev. | 0.15 | 0.11 | 0.38 | 1.19 | 1.72 |
| 140° F. | | | | | |
| Weight % Lost | 1.25 | 2.26 | 4.56 | 8.13 | 11.87 |
| Standard Dev. | 0.07 | 0.12 | 0.34 | 0.79 | 1.10 |
| Controls (Prior Art Package) 100° F. | | | | | |
| Weight % Lost | 2.85 | 4.21 | 7.21 | 13.52 | 20.21 |
| Standard Dev. | 1.29 | 1.57 | 2.04 | 3.09 | 4.26 |
| 120° F. | | | | | |
| Weight % Lost | 3.73 | 6.81 | 16.52 | 31.45 | 44.96 |
| Standard Dev. | 4.03 | 5.13 | 10.31 | 14.96 | 18.81 |
| 140° F. | | | | | |
| Weight % Lost | 5.45 | 10.17 | 20.84 | 37.58 | 52.44 |
| Standard Dev. | 3.03 | 4.51 | 8.10 | 14.48 | 18.58 |

As described and shown in the above tables, moisture retention package 200 employing moisture retention seal 206 in accordance with the principles of the present invention is an effective means to prevent moisture loss from plastic moisture retention package 200. The moisture retention effects of partial seals 206A-206D combine to form moisture retention seal 206 that is significantly more effective than prior art seal 106 (FIG. 1C). Moisture loss at elevated storage temperatures from moisture retention package 200 is only about 17 to 25%, on average, of the loss from a prior art package 100 (FIG. 1A). Said another way, moisture retention package 200 has a "moisture loss factor" of about 17% to 25%, where the moisture loss factor is defined as the cumulative weight percent moisture loss from an improved package, such as moisture retention package 200, divided by the cumulative weight percent moisture loss from prior art package 100 (FIG. 1A) for the same moistening solution, under the same conditions over the same time duration. As described above prior art package 100 comprises a standard prior art sidewall undercut surface 126 and a standard prior art skirt bead surface 128, well known to those of ordinary skill in the art. As described, prior art sidewall undercut surface 126 cooperates with prior art skirt bead surface 128 to form prior art seal 106.

Figure 3A:
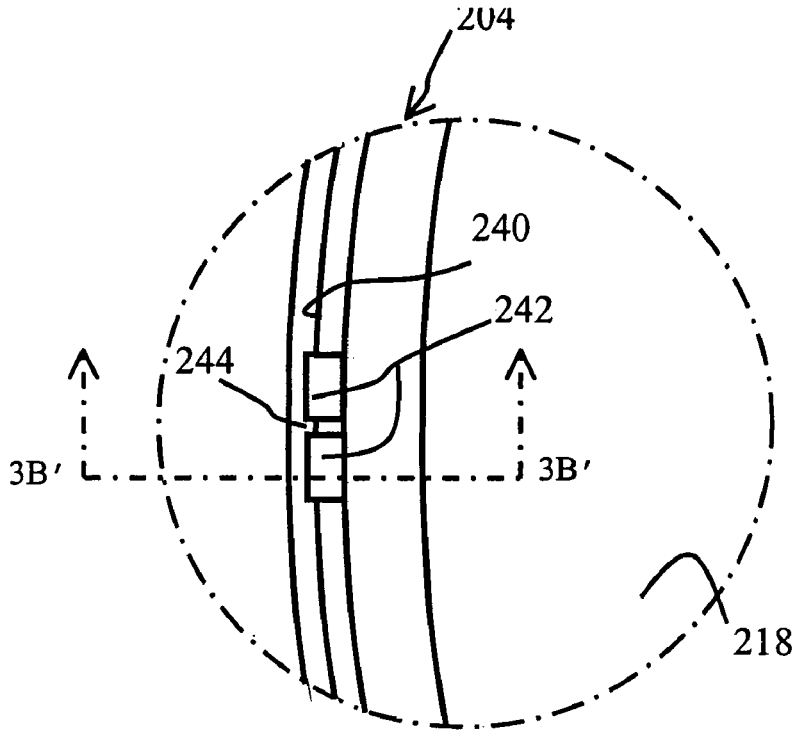
FIG. 3A is a partial, close-up, top view of the moisture retention closure of FIG. 2A showing moisture retention closure ring stand-offs that provide venting to the moisture retention package of FIG. 2A.
Figure 3B:
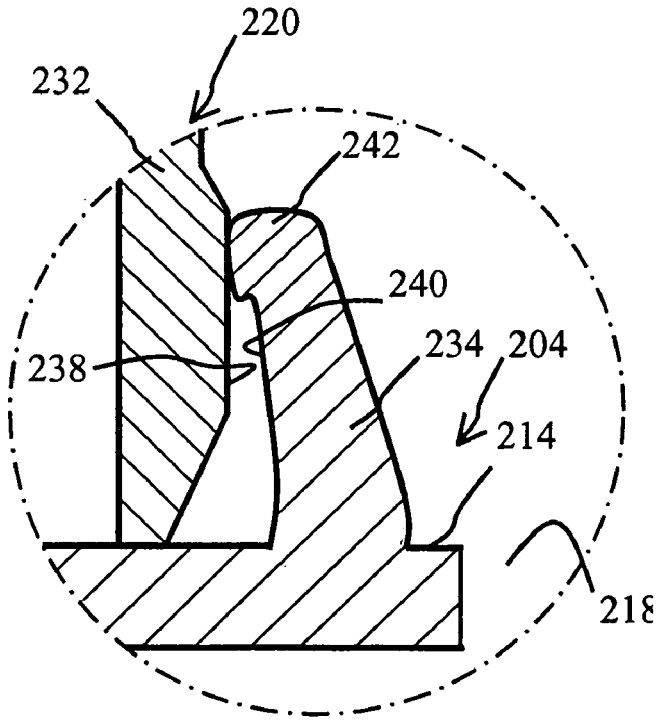
FIG. 3B is a close-up, partial, cross-sectional side view of moisture retention closure 204 as in FIG. 2B along line 3B'_____3B' of FIG. 3A also showing an aperture lid 220 in a closed relationship with the moisture retention closure.

As noted above, with reference to FIGS. 2A and 2B, in one embodiment, moisture retention closure 204 includes a top 214, generally configured as a disk, and a skirt 216, generally configured as an annular ring or skirt, coupled to and depending downwardly from top 214 at the peripheral edge of top 214. Top 214 defines an aperture 218 (FIG. 2B) therethrough for extracting material or objects contained in moisture retention canister 202 from opened-end portion 212 (FIG. 2B). Moisture retention package 200 further includes an aperture lid 220 (FIG. 2A) to close off aperture 218. Aperture lid 220 may be coupled to moisture retention closure 204 by a living hinge 222, by which aperture lid 220 pivots with respect to moisture retention closure 204 to close off aperture 218 (FIG. 2B) of moisture retention closure 204 FIG. 3A is a partial, close-up, top view of the moisture retention closure of FIG. 2A showing moisture retention closure ring stand-offs 242 that provide venting to moister retention package 200 (FIG. 2B). FIG. 3B is a close-up, partial, cross-sectional side view of the moisture retention closure 204 as in FIG. 2B along line 3B'_____3B' of FIG. 3A also showing an aperture lid 220 in a closed relationship with moisture retention closure 204. Referring to FIGS. 3A and 3B together, in one embodiment, moisture retention package 200 (FIG. 2A) may have a venting system. Providing a venting system to moisture retention package 200 allows release of excessive pressure buildup within moisture retention package 200 during elevated temperature testing or under excessive storage temperatures.

Figure 1B:
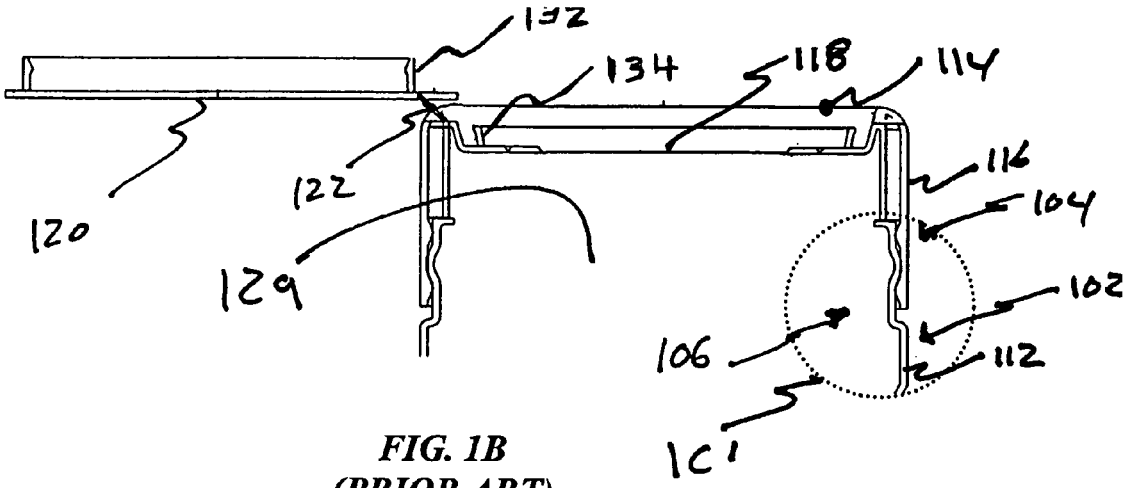
FIG. 1B (PRIOR ART)
FIG. 1B is a partial cross-sectional side view of an opened-end portion of the prior art canister of FIG. 1A after assembly with the prior art closure and showing a prior art seal.
Figure 1C:
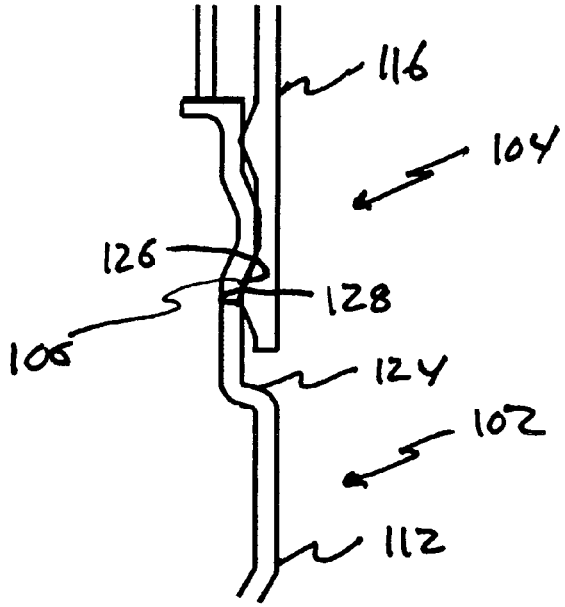
FIG. 1C (PRIOR ART)
FIG. 1C is a close-up view of the portion of FIG. 1B shown in dotted line and identified by reference number 1C' showing the prior art seal in detail.

In one embodiment, moisture retention closure 204 includes a moisture retention closure sealing ring 234 projecting upwardly from top 214 of moisture retention closure 204, similar to closure sealing ring 134 of prior art closure 104 shown in cross-section in FIG. 1B. Aperture lid 220 includes a lid sealing ring 232 (FIG. 3B) near the outer peripheral edge on the bottom surface of lid 220, similar to lid sealing ring 132 of prior art closure 104 (FIG. 1B). To form a seal between aperture lid 220 (FIG. 3B) and moisture retention closure 204, aperture lid 220 is snap-fitted to moisture retention closure 204. Lid sealing ring 232 mates with a moisture retention closure sealing ring 234 formed on top 214 of moisture retention closure 204 when aperture lid 220 is pivoted, snap-fitted, and placed in a closed relationship with moisture retention closure 204 to form a seal as shown in FIG. 3B. More specifically, a lid ring inside surface 238 of lid sealing ring 232 abuttingly contacts and seats against a closure ring outside surface 240 of moisture retention closure sealing ring 234.

In this embodiment, to provide a venting system to moisture retention package 200 (FIG. 2A), moisture retention closure sealing ring 234 further includes a pair of spaced apart stand-offs 242 configured as projections that extend radially outward from closure ring outside surface 240. Stand-offs 242 define a vent gap 244 through which excessive pressure within moisture retention package 200 may be vented. Excessive pressure within moisture retention package occurs whenever the pressure within moisture retention package 200 is more than the pressure needed to overcome the snap-fit force between aperture lid 220 and moisture retention closure 204. Said another way, excessive pressure within moisture retention package occurs whenever the pressure within moisture retention package 200 would cause aperture lid 220 to overcome its snap-fitting force and "pop" off moisture retention closure 204. In one embodiment, stand-offs 242 project about 0.0025 inches from closure ring outside surface 240 and stand-offs 242 are spaced apart by about 0.015 inches. In other embodiments, stand-off 242 may, alternatively, project radially inwardly from lid sealing ring 232.

From this disclosure, one of ordinary skill in the art would recognize that other conventional materials and fabrication techniques could be substituted. Also based on this disclosure, the person of ordinary skill in the art would further recognize that the relative proportions of the components illustrated could be varied without departing from the spirit and scope of the invention.

Although the moisture retention package 200 employing an embodiment of the moisture retention seal 206 of the present invention shown in the drawings and described herein as substantially cylindrical, in fact, other structures have surface shaped other than cylindrical could employee the moisture retention seal 206 described and shown to achieve improved moisture retention over conventional prior art seals. Corresponding first and second component surface portions need only be of any suitable shape or cross-section to provide a sealing interface therebetween. The substantially cylindrical shape shown herein is believed to be advantageous because it may be efficiently and inexpensively manufactured using commonly available molding techniques.

Although the above discussion discloses various exemplary embodiments of the invention, it should be apparent that those skilled in the art can make various modifications that will achieve some of the advantages of the invention without departing from the true scope of the invention.

What is claimed is:

1. A package comprising:

a closure having an interior surface and a protrusion extending from the interior surface; and a canister having a flexible top portion, the protrusion contacting the flexible top portion of the canister, the protrusion normally applying a generally downward contact force to at least part of the flexible top portion to form a top seal between the closure and the canister, the protrusion deflecting the part of the flexible top portion generally downwardly from a rest position, wherein the flexible top portion of the canister is in the rest position when not connected with the closure, the protrusion deflecting the flexible top portion by a deflection angle from the rest position, the deflection angle being less than about ninety degrees when connected.

2. The package as defined by claim 1, wherein the flexible top portion has a generally annular shape.

3. The package as defined by claim 1, wherein the protrusion generally circumferentially extends about the top interior surface.

4. The package as defined by claim 1, wherein the closure has a top and a skirt, the skirt having a plurality of microbeads to form a microbead seal between the closure and the canister.

5. The package as defined by claim 1, wherein the closure has a top and a skirt, the skirt being secured to the canister, the skirt having a bead with an inner dimension, the canister having a corresponding undercut surface having an outer dimension, the bead inner dimension being smaller than the undercut surface outer dimension.

6. The package as defined by claim 5, wherein the bead and the undercut surface form a bead seal.

7. The package as defined by claim 1, wherein the closure further comprises an interior sidewall surface radially inward of the protrusion, the sidewall surface contacting the canister to form a sidewall surface seal.

8. The package as defined by claim 1, wherein the flexible top portion of the canister has two opposed sides along its longitudinal dimension, both opposed sides being generally sinusoidally shaped, a terminal portion of the top portion contacting the protrusion.

9. The package as defined by claim 1, wherein said protrusion is generally rigid.

10. The package as defined by claim 1, wherein the closure defines a closure aperture therethrough.

11. The package as defined by claim 10, further comprising a lid for closing the closure aperture.

12. The package as defined by claim 11, further comprising a living hinge coupling the lid to the closure.

13. The package as defined by claim 1, further comprising:

a venting system having a closure sealing ring with stand-offs, the stand-offs extending from the sealing ring and being spaced to define at least one gap.

14. The package as defined by claim 1, wherein the canister forms an interior containing moist material.

15. The package as defined by claim 14, wherein the moist material comprise moistened wipes.

16. A method of forming a package for retaining moisture, the method comprising:

providing a closure having an interior surface with a downwardly extending protrusion;

providing a canister having a flexible top portion; and connecting the closure to the canister so that the protrusion contacts the flexible top portion of the canister and applies a generally downward contact force to at least part of the flexible top portion to form a top seal between the closure and the canister, connecting causing the top protrusion to pivot the part of the flexible top portion generally downwardly less than about ninety degrees from a relaxed position.

17. A method according to claim 16, wherein the closure has a top and a skirt depending from the top, the skirt having a plurality of micro-beads to form a microbead seal between the closure and the canister.

18. A method according to claim 16, wherein the closure has a top and a skirt depending from the top, the skirt having a bead with an inner dimension, the canister having a corresponding sidewall undercut surface having an outer dimension, the bead inner dimension being smaller than the sidewall undercut surface outer dimension, the bead and the sidewall undercut surface forming a bead seal.

19. A method according to claim 16, wherein the closure has a top undercut surface extending circumferentially about the top interior surface, and the canister has a sidewall bead surface circumferentially extending about the canister inwardly of a sidewall upright surface, the top undercut surface cooperating with the sidewall bead surface to form an undercut seal.

20. A method according to claim 16 wherein the package closure defines a closure aperture therethrough.

21. A method according to claim 20, wherein the package closure further includes an aperture lid for closing off the closure aperture, the aperture lid being coupled to the package closure by a living hinge.

22. A method according to claim 16, wherein the closure further comprises a venting system including a closure sealing ring having stand-offs, the stand-offs extending from the sealing ring, the stand-offs being spaced to define a gap.

23. A method according to claim 16, further comprising:

adding moistened wipes within an interior of the canister.

24. A package comprising:

a closure having a top interior surface and first means for sealing, the first means extending from the top interior surface; and a canister having flexible means for sealing, the first sealing means contacting the flexible sealing means, the first sealing means normally applying a generally downward contact force to at least part of the flexible sealing means to form a top seal between the closure and the canister, the first sealing means generally downwardly pivoting at least the part of the flexible sealing means less than about ninety degrees from a relaxed position.

25. A package according to claim 24, wherein the closure has a top and a depending skirt, the skirt being secured to the canister, the skirt having microbead sealing means to form a microbead seal between the closure and the canister.

26. A package according to claim 24, wherein the closure comprises a skirt that is generally radially outward of the first sealing means, the closure further comprising an interior sidewall radially inward of the first sealing means, the interior sidewall contacting the flexible sealing means to form an interior seal.

27. A package according to claim 24, further comprising a venting system including ring sealing means having stand-offs extending from the ring sealing means, the stand-offs being spaced apart to define at least one gap.

* * * * *